United States Patent [19]

Watson

[11] 4,080,762

[45] Mar. 28, 1978

[54] FLUID-ABRASIVE NOZZLE DEVICE

[76] Inventor: John D. Watson, 906 E. Harmony La., Fullerton, Calif. 92631

[21] Appl. No.: 718,000

[22] Filed: Aug. 26, 1976

[51] Int. Cl.[2] ..... B24C 7/00

[52] U.S. Cl. ..... 51/439

[58] Field of Search ..... 51/8 R, 11, 319–321, 51/439

[56] References Cited

U.S. PATENT DOCUMENTS

| | | | |
|---|---|---|---|
| 1,171,286 | 2/1916 | Wadsworth | 51/11 X |
| 2,376,616 | 5/1945 | Oechsle | 51/11 |
| 2,717,476 | 9/1955 | Myers | 51/11 |
| 3,069,812 | 12/1962 | Shelton | 51/11 |
| 3,690,067 | 9/1972 | Goss | 51/11 |
| 3,828,478 | 8/1974 | Bemis | 51/11 |

FOREIGN PATENT DOCUMENTS

| | | | |
|---|---|---|---|
| 730,756 | 5/1955 | United Kingdom | 51/11 |

*Primary Examiner*—Gary L. Smith
*Attorney, Agent, or Firm*—Francis X. LoJacono, Sr.

[57] ABSTRACT

A fluid-abrasive nozzle adapted for use as a controlled discharge means in combination with a high-pressure system for discharging a fluid-abrasive stream at a high velocity, whereby unwanted material on a given surface can be removed, or wherein the texture or physical characteristics of such surface can be altered by the controlled discharge from the nozzle, the nozzle being removably mounted to a gun-like support handle. Fluid under high pressure and flow is pumped through a pressure port in the main body and through a plurality of controlled-diameter orifices positioned annularly about a discharge ring in an inclined plane, whereby the fluid passing therethrough converges toward a common point downstream thereof. The high-velocity fluid streams leaving the front of the discharge ring pass through respective clearance holes formed in a centrally disposed piston whereby a venturi effect and resulting negative pressure are created by the cone-shaped spray formed by the converging fluid streams. This negative pressure allows the abrasive or other agents to be drawn through the central passage of the piston, thereby introducing the abrasive into the fluid streams to intermediate and produce an effective blasting pattern of the desired size and shape.

12 Claims, 8 Drawing Figures

FLUID-ABRASIVE NOZZLE DEVICE

BACKGROUND

1. Field of the Invention

This invention relates generally to a high-pressure, high-velocity, fluid-abrasive apparatus and, more particularly, to a fluid-abrasive nozzle adapted for use in such an apparatus.

2. Description of the Prior Art

At the present time, there are various abrasive-type blasting systems known which are used for removing painted or plastered surfaces. Many houses—particularly houses covered with a stucco material—after years of having several coatings of paint, must have these layers removed prior to providing a new coating of paint. Once the previous coatings of paint start to peel, they must all be removed and this is very often done by a sandblasting method.

Further, since the advent of a large number of private swimming pools, there has been created a need for providing a suitable apparatus or means to remove the first layer of plaster when it is found that the pool walls should be redone.

Most work of this type had been done by a method known as "dry-sandblasting" which is rapidly finding disfavor due to the emvironmental problems created by clouds of dust that are formed during the use of dry sand which is blown under high pressures.

Hence, in recent years the removal of unwanted materials or the need to change the physical characteristics of surface textures has brought forth combination wet and dry systems, these systems generally being referred to as "fluid-abrasive systems" wherein the fluid and various types of abrasives are intermingled and then discharged through a gun-like apparatus to obviate many of the above-mentioned problems.

However, this new method of mixing both a fluid and a dry abrasive also has created its own inherent problems. One problem is the wear on various parts. Another important problem is the inability to control the discharge patterns, since the effective pattern covered by most blasting systems is approximately two inches in diameter, which is not conducive to providing a smooth removal surface. A small pattern provides a poor distribution of abrasive within the pattern circle, thereby resulting in grooving and irregular blasting patterns, particularly on plaster surfaces.

Thus, it has been found that effectiveness of blast, blasting pattern, and nozzle characteristics of the known devices are extremely erratic. In addition, this problem did not vary directly with the different orifice sizes of a nozzle and, thus, could not be predicted. In fact, variations are found to be severe from nozzle to nozzle, even where each is provided with an identical-size orifice.

Further, the nozzles as employed in known systems require 10,000–12,000 p.s.i. pump-output pressure to accomplish effective surface erosion, resulting in frequent break-down periods of the equipment, and creating a shortened useable life and an increased safety hazard.

Since the present known nozzle has a single orifice, a very ineffective venturi effect is established, resulting in an inconsistent abrasive flow and difficulty in drawing the abrasive any appreciable distance, due to the lack of necessary vacuum in the abrasive line at the reservoir.

Accordingly, the applicant hereinafter discloses a unique fluid-abrasive nozzle that overcomes the foregoing mentioned problems.

SUMMARY

The present invention discloses a fluid-abrasive nozzle adapted to be employed in various well-known, high-pressure, fluid-abrasives systems. This nozzle provides a means whereby the discharge pattern can be controlled not only in size, but also in providing an excellent distribution of abrasive material throughout the entire pattern circle. This means the removal of surface materials can be accomplished without causing grooving or irregular blasting patterns on plaster surfaces.

The fluid-abrasive nozzle comprises a main body adapted to be affixed to a gun-like device. The main body includes a fluid-pressure inlet to which the fluid line of the pressure system is connected. From the main body, the fluid flows through a plurality of predetermined-size orifices which are angularly disposed circumjacent about a discharge ring. These orifices are inclined forwardly to provide a cone-shaped pattern, whereby the fluid passing therethrough converges toward a common point downstream at the outlet opening defined by a nozzle housing having a removable insert member located therein, to control andguide the abrasive material also flowing therethrough.

The high-velocity fluid streams leaving the front of the discharge ring pass through the clearance hole arranged in the head of a piston to be aligned with respective orifices to create a venturi effect, thereby resulting in a negative pressure in the cone formed by the converging fluid streams.

The piston is centrally positioned within the main body and extends rearwardly and outwardly therefrom, and is connected to the abrasive-agent inlet member which, in turn, is connected to the abrasive-material inlet line from the abrasive system. The abrasive flow therethrough is due to the vacuum created within the forward area of the nozzle, and intermingles at this point with the discharging fluid.

OBJECTS AND ADVANTAGES

The present invention has for an important object a provision wherein a high-velocity fluid-abrasive stream can be controlled to remove a particular unwanted material from a given surface, or to change the texture or physical characteristics of such surface.

It is another object of the present invention to provide a fluid-abrasive nozzle that includes a plurality of circumferentially disposed orifices that evenly discharge high-pressure fluids to create a cone-shaped spray, whereby a higher vacuum is established in the discharge end of the nozzle.

It is still another object of the present invention to provide a fluid-abrasive nozzle that has an effective pattern covered by the blast stream of approximately six inches in diameter.

It is a still another object of the invention to provide a fluid-abrasive nozzle which has an effectiveness of blast, blasting pattern and nozzle characteristics that are consistent and predictable to the extent that curves can be established from which pressure, fluid flow, orifice size, jet velocity, etc., are selected to provide various desired results.

It is a further object of the invention to provide an apparatus of this character that includes a very effective venturi which distributes and accelerates abrasive particles consistently, resulting in commingling with the fluid uniformly throughout the spray pattern, and wherein the abrasives are drawn effectively 100 feet or more without air-pump boost.

Still another object of the invention is to provide a device of this character wherein the vacuum measured in the abrasive line at the reservoir thereof is 10–20 inches of mercury, which is much higher than is capable with the known systems.

It is still another object of the inventon to provide a device of this character that is simple and rugged in construction, and has no moving parts wherein all seals are static.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
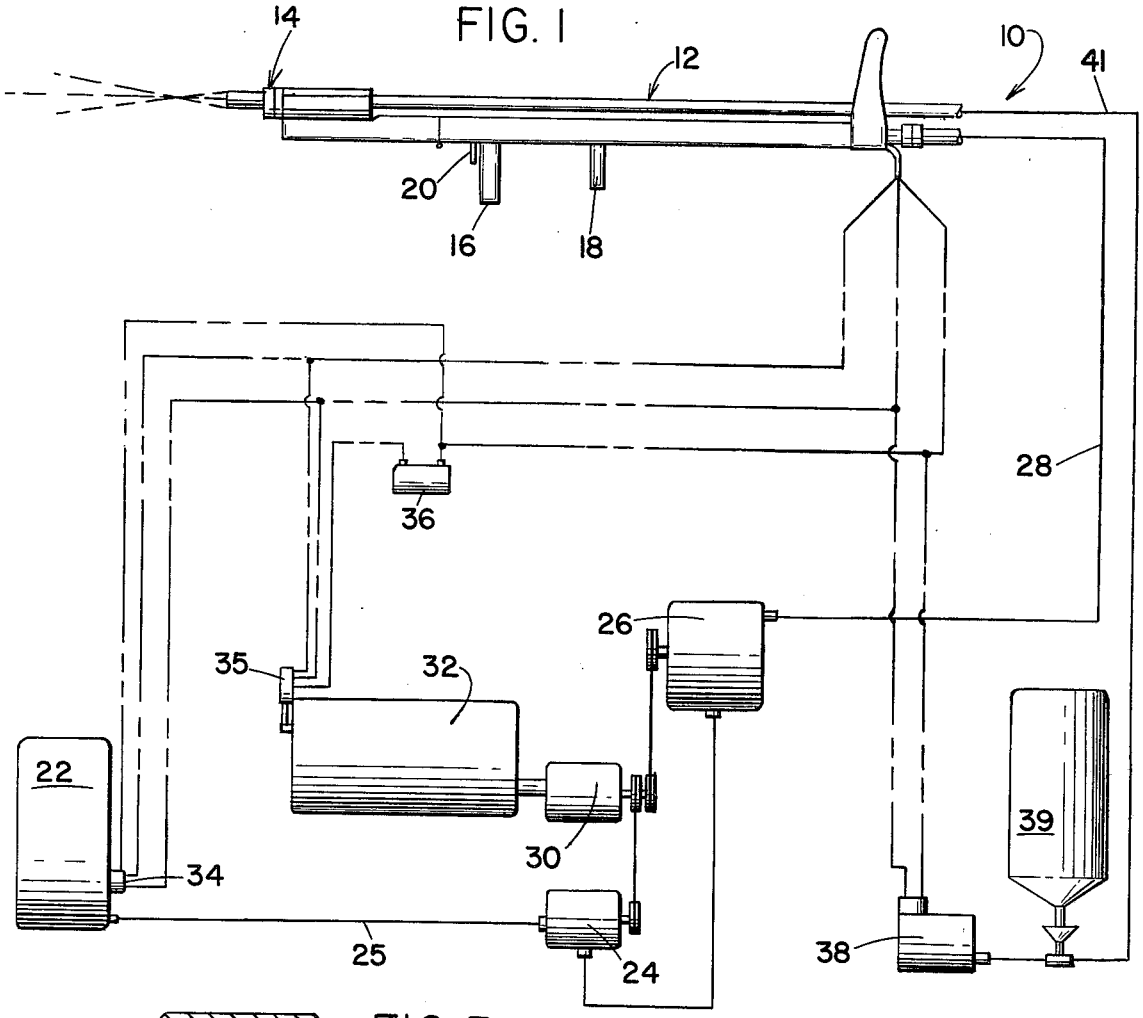
FIG. 1 illustrates the present nozzle mounted to a gun-like unit which is interconnected within a typical high-pressure, fluid-abrasive, flow system shown diagrammatically.
Figure 3:
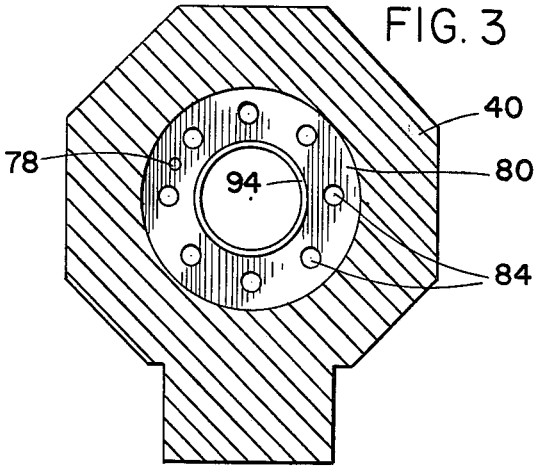
FIG. 3 is a cross-sectional view taken along line 3—3 of FIG. 2.

Referring more particularly to the drawings, there is shown in FIG. 1 a high-pressure fluid-abrasive system, generally indicated at 10, having a discharge gun, designated at 12, operably connected within said system 10. The gun 10 houses the present invention which is the fluid-abrasive nozzle, indicated generally at 14. The gun 12 can be of any suitable design having a forward and a rear handle 16 and 18, respectively, wherein an operating switch means 20 is provided adjacent the forward handle 16.

It should be noted that various high-pressure systems can be incorporated to provide the necessary flows; and the system shown in FIG. 1 is presented as one example thereof. This particular system 10 comprises a fluid reservoir 22 connected to a supply pump 24 by pipe 25, shown as a solid line. From supply pump 24, fluid is transported to a high-pressure pump 26 which, in turn, is connected to the nozzle 14 through line 28. The supply pump 24 and high-pressure pump 26 are operably connected to a pump drive 30 which is powered by any well-known suitable engine 32.

Also shown in FIG. 1 are various electrical lines which interconnect the level-control means 34, engine regulating means 35, battery 36, and air pump 38 to the switch means 20 adjacent the handle 16 of said gun 12.

Air pump 38 is connected upstream of the abrasive-agent reservoir 39 which supplies various selective abrasive materials or chemicals to nozzle 14 through abrasive line 41.

It is also important to note that, with this particular system being remotely controlled by switch means 20, the flow of fluids and abrasive agents are turned off remotely from said nozzle and gun, thereby providing a safety feature for the person operating the gun.

Figures 2, 5, 6, 7, 8:
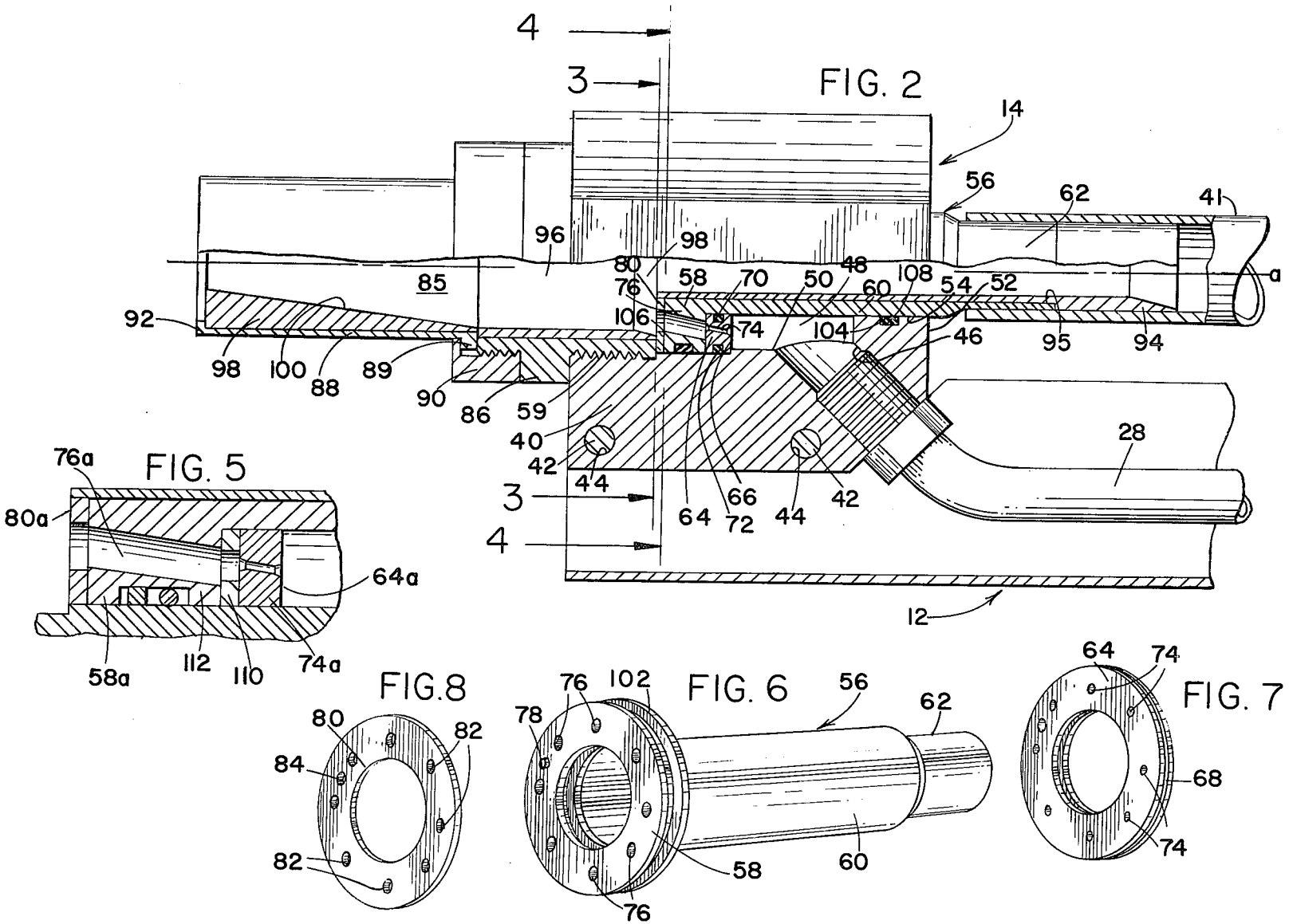
FIG. 2 is an enlarged side-elevational view of the nozzle wherein the lower portion is sectioned to illustrate the inlet fluid and abrasive lines attached thereto.
FIG. 5 is an enlarged sectional view of an alternative arrangement of the nozzle discharge ring.
FIG. 6 is a perspective view of the piston.
FIG. 7 is a perspective view of the discharge ring member.
FIG. 8 is a perspective view of the forward ring shield.

The fluid-abrasive nozzle 14 comprises a main body 40 adapted to be removably attached to gun unit 12 by means of bolts 42 which pass through bores 44 in the lower portion of body 40, as seen in FIG. 2. Said main body 40 includes a fluid inlet passage 46 which is threaded to receive the fluid line 28.

Thus, fluid under high pressure passes through inlet passage 46 and enters a pressure chamber 48 defined by the enlarged bore 50 formed in body 40. The rear wall 52 of body 40 is also provided with a reduced-diameter bore 54 through which is received a piston, generally indicated at 56, which defines an abrasive-inlet means. The piston 56 is so arranged as to be mounted within a portion of bore 50, a piston head 58 being located in the forward portion of said bore 50 adjacent the internal threads 59 thereof, and a rearwardly extending tubular body 60 passing through chamber 48 and bore 54. The terminating end 62 of body 60 is provided with a reduced diameter so as to be removably attached to abrasive line 41.

Before piston 56 is inserted into body 40, a high-pressure fluid-discharge means defined by discharge ring 64 is positioned over rearwardly extending tubular body 60, said ring being located adjacent piston head 58. Thereafter, both the piston 56 and the discharge ring 64 are received within body 40, the ring 64 being arranged between piston head 58 and an annular shoulder 66 formed in bore 50. Said ring 64, as clearly seen in FIG. 7, includes an inner annular groove 67 and an outer annular groove 68 in which "O"-ring seals 70 and 72, respectively, are located. Disposed about the annular body of ring 64 are a plurality of controlled orifices 74. Said orifices 74 are equally spaced apart in a circular arrangement, and each is inclined forwardly and inwardly towards the center axis a-a of the nozzle. Hence, each fluid stream being ejected from said orifices will converge toward a common point downstream. It should be noted that the number, positions, sizes, and angles of incline of said orifices may be varied as desired to provide various fluid velocities, blasting patterns, and other characteristics— including circular patterns, oval patterns, fan patterns, swirl patterns etc.

Figure 4:
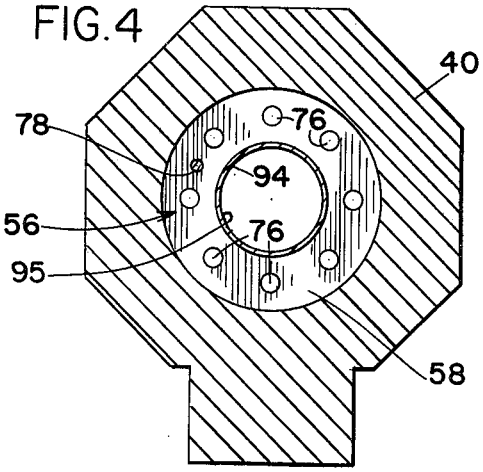
FIG. 4 is a cross-sectional view taken along line 4—4 of FIG. 2.

The high-velocity fluid streams leaving the front of the discharge ring 64 pass through a plurality of matching clearance holes 76 disposed within piston head 58. Said holes 76 and orifices 74 are aligned with each other by an alignment means indicated as an index pin 78 affixed within piston head 58, and extend forwardly and rearwardly therefrom as seen in FIGS. 4 and 6. The location and arrangement of the holes 76 and orifices 74 create a venturi effect and result in a negative pressure in the cone-shaped spray formed by the converging fluid streams. This negative pressure (vacuum) draws the abrasive or chemical agent from reservoir 39 through line 41 into piston 56, wherein the abrasive or like material is introduced into the fluid streams to intermingle therewith and produce an effective blasting pattern of the desired size and shape.

After the piston 56 is in place within the main body 40, there is superposed over the front of the piston head 58 a shielding means, which comprises a ring shield 80 which is also provided with a plurality of matching holes 82, and an alignment aperture 84 in which the forward portion of the index pin 78 is received. The holes 82 will correspond with holes 76 of the piston head 58. This shield 80 provides protection against wear on the piston head, and can be replaced when needed due to the wear created by the abrasive material.

Accordingly, the high-velocity fluid streams and abrasive material intermingle within the forward end of the nozzle, wherein mixing chamber 85 is defined by the following elements. Thus, when shield 80 is positioned, a threaded nipple 86 is received in threads 59 of the main body 40, locking the above elements in place within bore 50.

Mounted to the forward end of said nipple 86 is a tubular jacket 88 having an enlarged annular flange 89 which is supported in a connecting collar 90, said connecting collar being threadably attached to nipple 86. The forward or leading discharge end of said jacket is provided with an inwardly turned shoulder 92.

Since the various elements, such as piston 56, nipple 86 and jacket 88, are directly exposed to wear created by the impinging abrasive material, there is provided for each element thereof a throw-away member, as seen in FIG. 2.

First, the incoming abrasive material enters piston 56 which includes a removable liner 94 which extends the full length of the central-piston passage 95. As the abrasive reaches the mixing chamber 85, the inner annular wall of nipple 86 is protected by a removable sleeve 96 which includes a beveled edge 98 positioned adjacent shield 80. Following sleeve 96 and disposed within jacket 88 is an insert member 98 having a conical funnel-shaped interior wall 100, wherein the thickest portion thereof is arranged at the discharge end of the jacket where the greatest wear occurs.

It should also be noted that both the piston head 58 and the bore 54 of rear wall 52 are provided with annular grooves 102 and 104, respectively, to house "O"-ring seals 106 and 108, respectively.

However, there is an alternative arrangement shown in FIG. 5, wherein the discharge ring **64*a* does not include an inner or an outer groove. The sealing in this particular mode is provided by a sealing washer 110 interdisposed between ring 64*a* and the back surface of piston head 58*a*, the washer having a plurality of holes 112 to align with the aligned hole 76*a* and orifices 74*a*. Shield 80*a*, sealing washer 110 and discharge ring 64*a* are all aligned by index pin 78 of the piston 56**.

It should be further noted, that the nozzle as herein disclosed can be readily used effectively with liquid only, by disconnecting abrasive line 41 which supplies the supplementary agent. This arrangement permits removal of soft elements from soft surfaces such as wood or plastic without undue erosion of the parent material. The multiple jet feature provides an even distribution of high-pressure liquid impacting the surface uniformly over the blasting spray pattern, without the "hard" spots typically produced by single orifice nozzles which tend to erode the surface irregularly or in localized areas of the blasting pattern.

The present designed nozzle is applicable to a wide range of variables, including fluid pressures from 1,000 p.s.i. to 30,000 p.s.i., fluid flow rates from 1 g.p.m. to 35 g.p.m., and jet velocities from subsonic to supersonic conditions.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A fluid-abrasive nozzle device removably attacked to a gun-like structure for use in high-velocity, high-pressure fluid-pump systems, including an abrasive material, wherein the nozzle comprises:

a main body having a fluid-inlet passage and a pressure chamber formed therein, said inlet communicating with said pressure chamber and connected to said liquid pump system;

abrasive inlet means having a discharge end, said inlet means mounted within said main body to allow flow of abrasive material through said nozzle device;

fluid-discharge means disposed adjacent said pressure chamber and including a plurality of predetermined sized orifices disposed in said fluid discharge means and communicating with said pressure chamber;

a mixing chamber positioned at the discharge end of said abrasive inlet means and said fluid-discharge means, wherein said abrasive material is intermingled with the liquid being discharged through said orifices;

wherein said fluid-discharge means comprises an annular discharge ring having said orifices equally spaced apart from each other in a circular arrangement around said ring, said orifices being inclined inwardly and forwardly of said chamber, wherein high-velocity fluid streams are discharged into said mixing chamber, said fluid and said abrasive material being commingled to be discharged in a homogeneous manner;

wherein said abrasive inlet means comprises:

a piston having a central passage therethrough to provide flow of said abrasive material through said nozzle;

a piston head having a plurality of holes therethrough arranged in aligned relationship with said orifices of said discharge ring, said holes communicating with said mixing chamber whereby fluid from said orifices pass through said holes into said chamber.

2. A nozzle device as recited in claim 1, wherein said fluid being discharged from said orifices forms a conical-shaped high-velocity spray of a plurality of fluid streams converging within said mixing chamber, said spray creating a vacuum in said mixing chamber whereby said abrasive is drawn therein to intermingle with said fluids to be discharged from said chamber in a controlled pattern.

3. A nozzle device as recited in claim 2, wherein said discharge ring includes a sealing ring disposed therein.

4. A nozzle device as recited in claim 3, wherein said piston head includes sealing means in said head and said pressure chamber.

5. A nozzle device as recited in claim 4, wherein said mixing chamber comprises:

a nipple member removably secured to said main body securing said piston and said discharge ring in said pressure chamber;

a tubular extended jacket member forming the spray discharged from said nozzle; and a connecting collar removably connecting said jacket member to said nipple.

6. A nozzle device as recited in claim 5, including:

a removable liner superposed within said central passage of said piston;

a removable sleeve member positioned within said mixing chamber and located in said nipple member thereof; and a removable insert member positioned in said mixing chamber and located in said jacket member.

7. A nozzle device as recited in claim 6, wherein said insert member is formed with a conical inner wall having an enlarged-diameter opening positioned adjacent said sleeve member, and a reduced-diameter opening positioned at the discharge end of said jacket member.

8. A nozzle device as recited in claim 5, wherein said device includes a removable shield member positioned between said nipple member and said piston head, said shield having a plurality of holes therethrough and arranged in alignment with said holes in said piston head.

9. A nozzle device as recited in claim 8, wherein said piston includes an alignment means wherein said discharge ring and said shield member are mounted thereto, whereby said orifices of said discharge ring and said holes of said shield member are held in communicating alignment between said pressure chamber and said mixing chamber.

10. A nozzle device as recited in claim 7, wherein said device includes means for removably attaching said nozzle to a gun-like structure.

11. A nozzle device as recited in claim 2, wherein there is included a sealing washer disposed between said piston head and said discharge ring, said washer having a plurality of openings disposed therein in communicating alignment with said orifices and said holes in said piston head.

12. A nozzle device as recited in claim 11, wherein said device includes a removable shield positioned forward of said piston head to protect said piston head from wear, said shield having a plurality of openings disposed therein in matching alignment with said holes of said piston head.

* * * * *